US005118177A

United States Patent [19]

Ryczek

[11] Patent Number: 5,118,177

[45] Date of Patent: Jun. 2, 1992

[54] DRAWER AND DRAWER SUSPENSION SYSTEM

[75] Inventor: William F. Ryczek, Azusa, Calif.

[73] Assignee: The Stanley Works, New Britain, Conn.

[21] Appl. No.: 565,670

[22] Filed: Aug. 10, 1990

[51] Int. Cl.[5] ..... A49B 41/04

[52] U.S. Cl. ..... 312/345; 312/342

[58] Field of Search ..... 312/342, 345, 245, 246, 312/330.1, 341, 107

[56] References Cited

U.S. PATENT DOCUMENTS

| | | | |
|---|---|---|---|
| 732,721 | 7/1903 | Dunning | 312/342 |
| 2,885,694 | 5/1959 | Ulm | 312/246 |
| 3,317,262 | 5/1967 | Vogt . | |
| 3,387,906 | 6/1968 | Edwards . | |
| 3,452,878 | 7/1969 | Smith | 312/345 |
| 3,490,823 | 1/1970 | Neu et al. . | |
| 3,664,716 | 5/1972 | Johnson . | |
| 3,784,274 | 1/1974 | Holmes et al. . | |

FOREIGN PATENT DOCUMENTS

| | | |
|---|---|---|
| 89053117 | 6/1989 | Fed. Rep. of Germany . |
| 130375 | 2/1929 | Switzerland . |

*Primary Examiner*—Joseph Falk

*Attorney, Agent, or Firm*—Christie, Parker & Hale

[57] ABSTRACT

A drawer has oppositely facing flanges extending from the top of each side wall, perpendicular to each side wall, and a pair of rollers at each rear corner. Two drawer runners are mounted below a surface in alignment with the drawer side walls, each runner having oppositely facing flanges for engaging the drawer-mounted wheels and a pair of wheels for engaging the drawer-mounted flanges. The drawer runners have depressions for holding the drawer wheels in a closed position and ramps for slowing the drawer wheels before reaching the opened position. The drawer is assembled from parts which snap together. The drawer runners are specifically designed to snap into place below a set of horizontal steel planks forming a shelf.

29 Claims, 10 Drawing Sheets 8
5
10
4
7
9
12
27

DRAWER AND DRAWER SUSPENSION SYSTEM

FIELD OF THE INVENTION

The present invention relates to the field of drawers and drawer suspension systems and, in particular, to a drawer that can be suspended by a runner from below slats of a shelf, as described and illustrated in U.S. patent application Ser. No. 319,428, filed Mar. 2, 1989, now U.S. Pat. No. 4,995,323. The disclosure of which is incorporated herein fully by reference.

BACKGROUND OF THE INVENTION

Conventional drawers are typically supported by a slide fastened to the side walls of the drawer. The slide engages a runner mounted beside the slide on an inside cabinet wall or other vertical support. Another variety of drawer is supported on the bottom surface of its side walls on top of a long runner or set of rollers. These arrangements support the drawers securely, however, they require some sort of supporting structure to the side of or below the drawer. While it is also known to partially suspend a drawer from a runner mounted above the drawer, these systems typically require rollers underneath or on both sides of the drawer to stabilize the drawer and support its front end. See, e.g., U.S. Pat. No. 3,784,274 to Holmes, et al. and U.S. Pat. No. 3,387,906 to Edwards.

Unfortunately, it is not always possible or convenient to provide a supporting structure below or on the sides of a drawer. For example, if the drawer is to be hung from below a shelf, it would be inconvenient to build a support structure hanging down from the shelf merely to support the drawer. U.S. patent application Ser. No. 319,428 filed Mar. 2, 1989, now U.S. Pat. No. 4,995,323, discloses a modular shelving and hanger bar system which provides for shelves made up of four parallel elongated slats running the length of the shelf. The shelves are suspended by vertical support members at their fronts and by the wall at their backs. If a conventional drawer support system were used in which drawer runners are mounted below the drawer, then the drawers would either be placed on shelves where they would consume valuable shelf space, or bulky hanging supports would be required to reach down under the drawer from below a shelf. If conventional side mounted drawer runners were used, bulky hanging vertical members would have to be suspended from the drawers to support these runners. The hanging supports would limit the width of the drawer and add weight and complexity to the drawer support system. Accordingly, there exists a need for a drawer which can hang from below a shelf stably and securely balanced without any bottom or side support. Such a support system should hold the drawer in a closed position and prevent the drawer from being accidentally pulled out of its supports.

SUMMARY OF THE INVENTION

In one embodiment, the present invention includes a drawer support system for suspending a drawer below a plurality of slats. The system has at least two elongated drawer runners for supporting opposite sides of the drawer from above. Each runner has a means for engaging the plurality of slats from below the slats and a means for slidably engaging the drawer. The means for engaging the slats preferably comprises a plurality of bosses on each runner, where each boss has an upper surface and a channel below the upper surface for engaging the slats. The upper surface preferably has a trapezoidal U-shaped cross section. The means for engaging the drawer preferably has at least one bottom flange extending from each runner or two extending from each runner in substantially opposite directions. The bottom flange has an upwardly facing surface for engaging and supporting the drawer and the upwardly facing surface has a depression for engaging the drawer when the drawer is in a closed position and for retaining the drawer in the closed position. Preferably, the runners also each have a ramp facing the flange for slowing the drawer as it is moved to a fully opened position, as well as a stop adapted to abut the drawer when the drawer is in a fully opened position for restricting the drawer from opening further.

BRIEF DESCRIPTION OF THE DRAWINGS

These and other aspects of the invention will be more fully understood by referring to the following detailed description and the accompanying drawings wherein.

DETAILED DESCRIPTION

Figure 1:
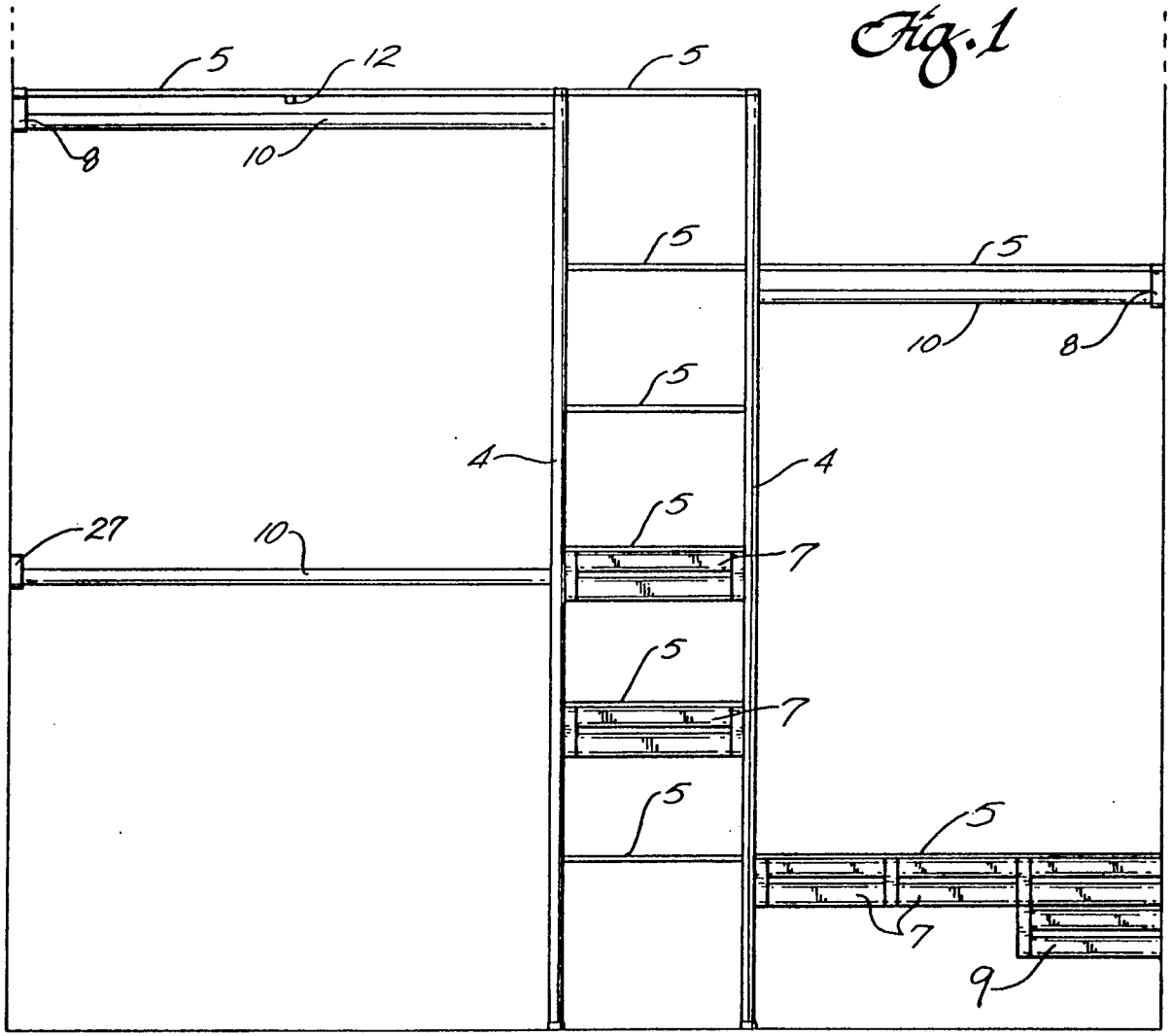
FIG. 1 is a front view of an exemplary configuration of a modular shelving and hanger bar system from which drawers are adapted to be supported.
Figure 2:
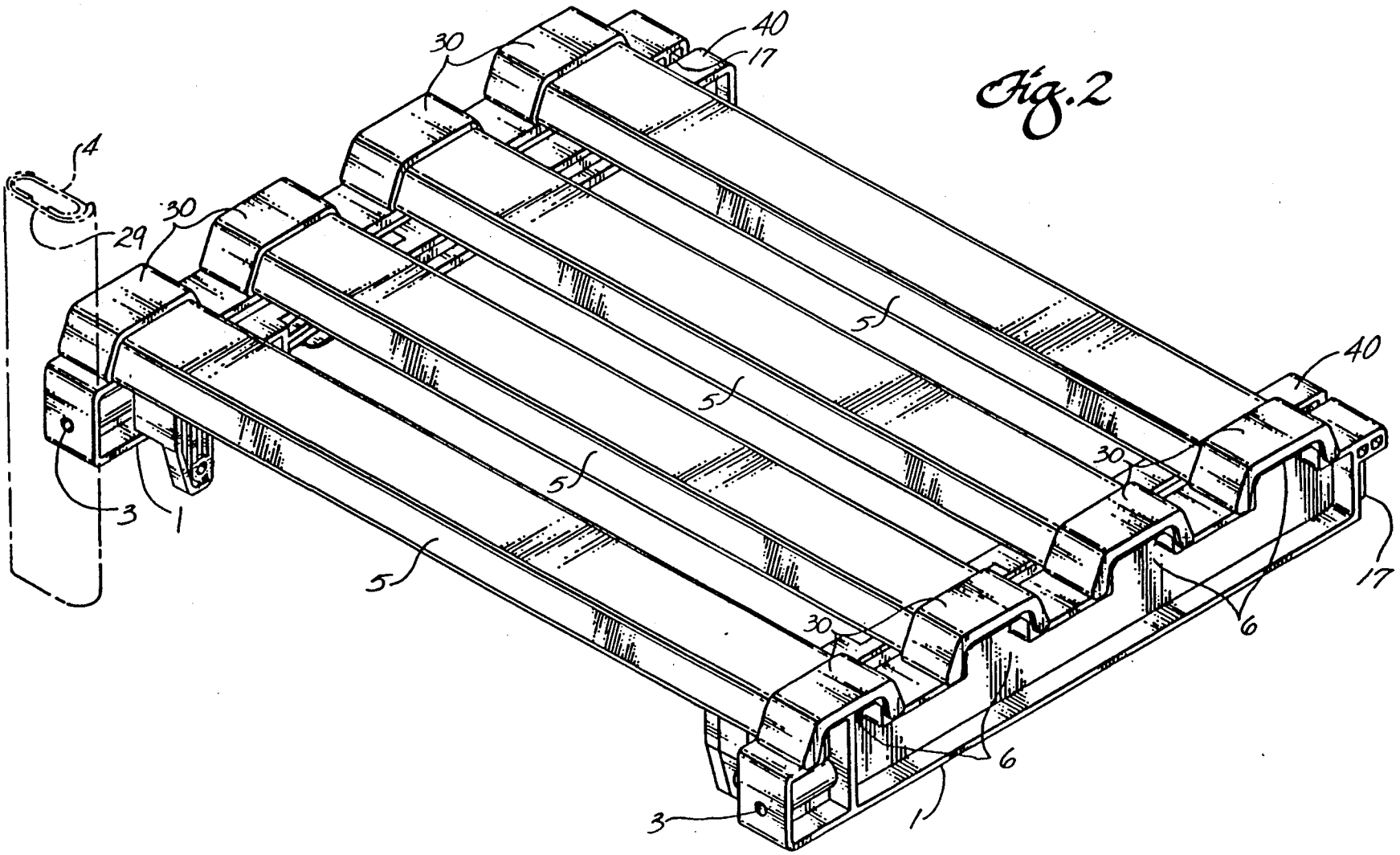
FIG. 2 is an isometric view of a shelf supporting two drawer runners.

FIG. 1 is a front view of one exemplary configuration of a modular shelving, hanger bar and drawer system, for which the present invention is particularly well suited, installed in a clothes closet. FIG. 2 shows the construction of a single shelf on the center stack of the system and a pair of drawer runners. The modular system can be installed in spaces of varying width and height and many shelf configurations and drawer locations are possible. In this example, a pair of vertical support members 4 support a plurality of horizontal support members 1, extending from each vertical support member to the back wall of a typical closet.

A plurality of steel shelf planks 5 extend between corresponding horizontal support members to create a center stack of shelves. Somewhat longer shelf planks extend from each side of the center stack to their respective side walls of the typical closet. A stiffening bridge 12 enhances the sturdiness of the longer plank members. A side wall shelf and hanger bar bracket 8 supports the longer shelf planks at the side wall. The side wall bracket 8 also supports one end of a hanger bar 10 provided below each shelf which extends to the side walls. A side wall hanger bar bracket 27 provides an alternative side wall support for a hanger bar. The other end of each hanger bar is supported by a socket integral with the corresponding horizontal support bracket. Such a system is more fully described in the aforementioned patent application, Ser. No. 319,428, filed Mar. 2, 1988 now U.S. Pat. No. 4,995,323.

Single height drawers 7 and a double height drawer 9 are supported from the shelf planks. These drawers are supported by runners 40 which couple to the shelf planks. Single height drawers are suspended from some of the shelves in the center shelf stack. The drawers preferably allow enough clearance for the shelves both above and below each drawer to be used. A second set of drawers hang from one of the longer shelves which extends to the closet side wall. The drawers can be hung in virtually any location from any of the shelves where there is no hanger bar 10.

A pair of elongated central shelf brackets 1 are each anchored at the back end to the back wall of the closet by a bracket (not shown), mounted to the back wall of the closet, which engages a cleat 17 on the back end of each central bracket. Alternatively, the bracket may be fastened to the back wall by a screw. The front end of each central bracket has a screw hole 3 and fastens to a vertical support member 4 which stands on the floor and extends toward the ceiling, but which need not be fastened to the floor or ceiling. The central shelf bracket and vertical support member combination provide the support for a plurality of shelf planks 5 which engage trapezoidal bosses 6 along the top of the central bracket 1. Protective decorative plank end caps 30 engage and cover the end of each plank.

The drawer runners 40 each have trapezoidal bosses 42 which engage the shelf planks 5 (FIGS. 3-5) from below the shelf planks. The drawer runner bosses snap into the shelf planks as discussed below with respect to FIG. 6. The trapezoidal bosses allow the runners to hang from the shelf planks without bulky additional vertical supports. The drawer runners support the side walls of a drawer as explained in more detail below. Accordingly, the drawer runners must be placed between the shelf support brackets and far enough away from the shelf support brackets to prevent a drawer, hanging directly below the runners, from being interfered with by a vertical support 4.

Figure 3:
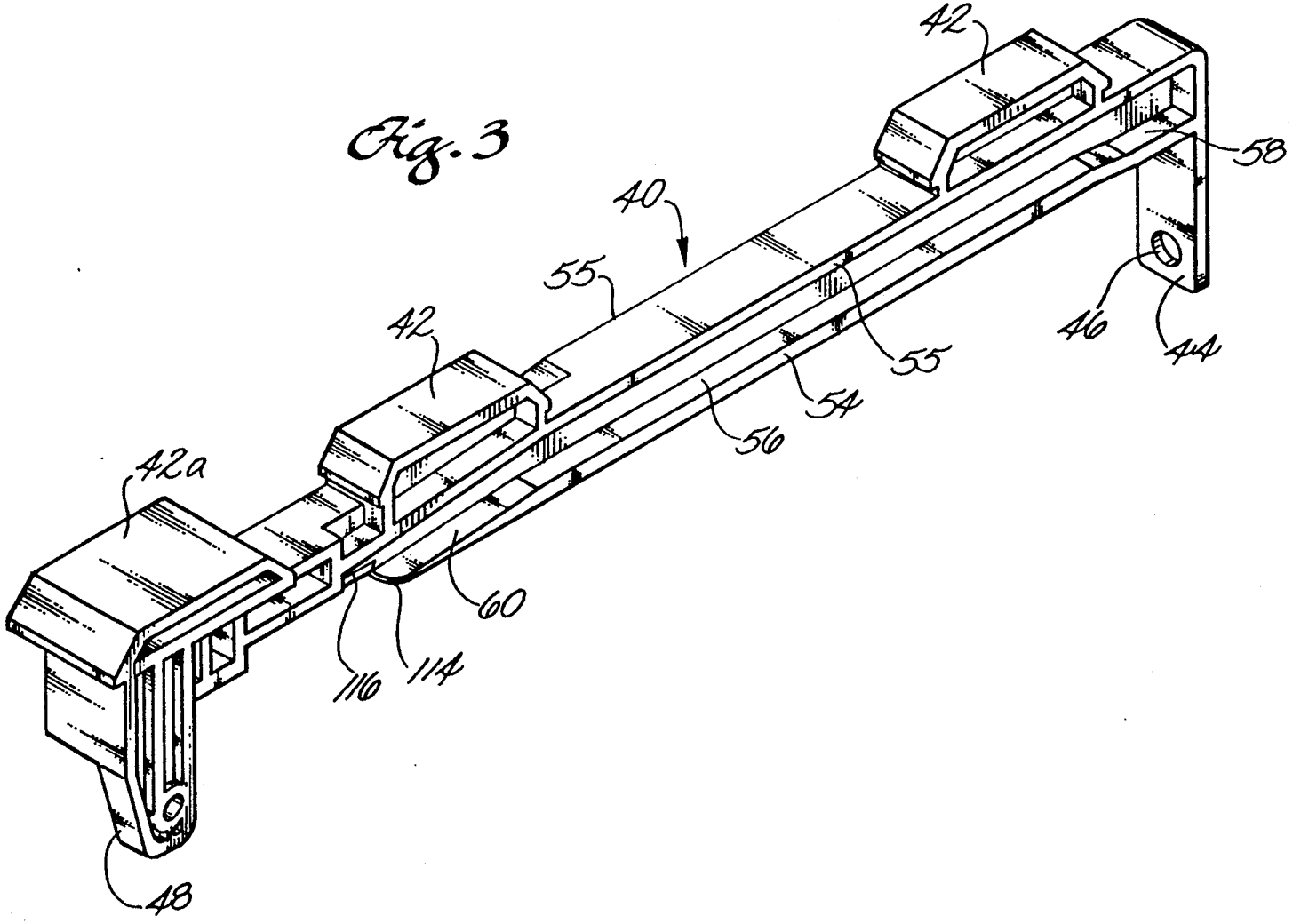
FIG. 3 is an isometric view of a drawer runner.

FIG. 3 shows the left hand side drawer runner of FIG. 2 unobscured by the shelf planks and brackets. The left and right hand side drawer runners are preferably mirror images of each other. The boss 42*a* at the front of each drawer runner is wider than the other bosses. Since a part of the drawer will extend beyond the front of the front boss, the front boss will be required to bear more weight. The wider boss increases the load bearing capacity of the front of the runner. Each drawer runner 40 has a symmetrical I-beam type cross section and is preferably constructed of a molded plastic such as reinforced polypropylene.

The rear end of the runner has a vertical plate 44 with a screw hole 46 through which a screw may be driven to hold the rear end of the drawer runner in place against a closet wall. The precise location of the rear end of the drawer runner is preferably determined by first installing a drawer and fastening the vertical plate to the location which best accommodates the drawer. Alternatively, a cleat and bracket system similar to that shown on the shelf bracket can be used or the rear end fastener can be eliminated altogether. While the bosses 42 normally prevent forward and rearward movement of the drawer runner, the vertical plate 44 further enhances the stability of the device by providing both horizontal and vertical support. It also provides a bumper which the drawer contacts when closed, protecting the closet wall.

Figure 4:
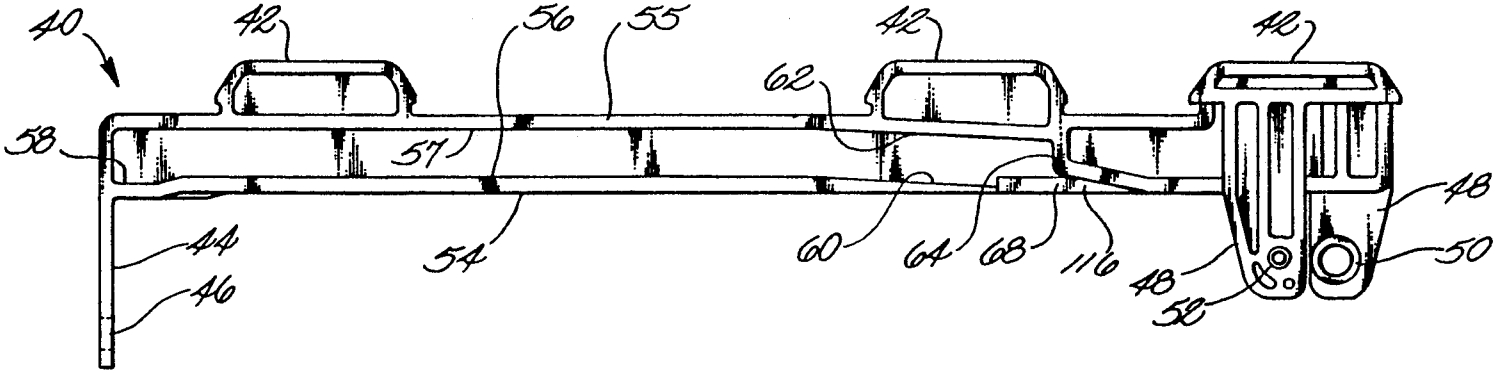
FIG. 4 is a side view of a drawer runner.
Figure 5:
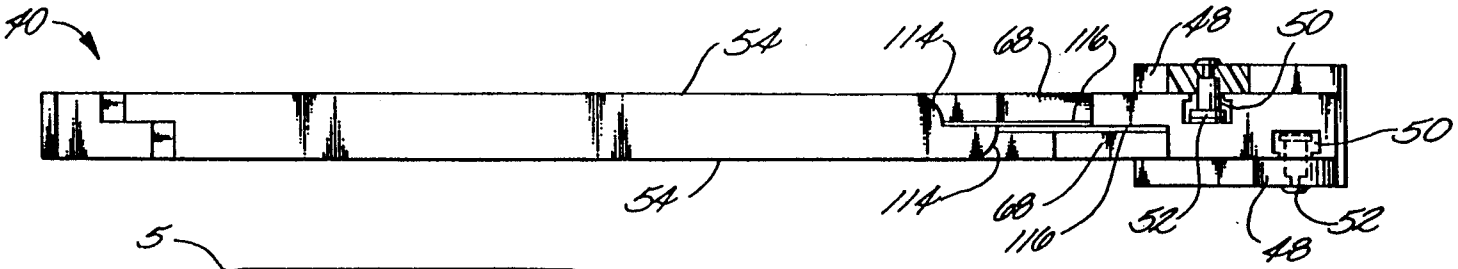
FIG. 5 is a bottom view of a drawer runner.

At the forward end of the drawer runner, directly below the front boss, are a pair of downwardly pointing legs 48 which support wheels 50 from axles 52 (FIGS. 4 and 5). The legs extend from the outer sides of the runner, and the wheels are located between the legs, however, this configuration can be reversed or altered. The legs are preferably offset from each other so that the wheels have axles which are offset from each other in the fore and aft directions and are in the same horizontal plane. This further stabilizes the action of the drawer as it rolls against the wheels and simplifies injection molding of the runners.

Between the rollers and the rear end plate is a T-shaped flange comprising two flanges 54 extending in substantially opposite directions from the runner and forming the arms of the T. These flanges are designed to engage wheels on the drawer and support the drawer in place. The drawer has a pair of rollers at its rearward end which roll on the flanges 54 to support the back and rearward part of the drawer. The rollers rest on the upper surface 56 of the runner flange. Matching parallel upper flanges 55 each have a downwardly facing surface 57 opposite the upper surface 56 upon which the rollers also roll when the center of gravity of the drawer is forward of the wheels on the runner. The two surfaces form a channel which controls the movement of the wheel. The rearward end of the lower flange has a depression 58 with an inclined edge in which the drawer rollers rest when the drawer is closed. The depressions are offset on opposite sides of the drawer runner because the rollers at the rear end of the drawer, as shown in FIGS. 8 through 11, are offset as well.

The forward end of the upwardly and downwardly facing surfaces 56, 57 have ramps 60, 62, respectively, which face each other. As the drawer is pulled outward toward its open position, the weight of the front of the drawer will typically push the rear of the drawer upwards and bring the drawer's rollers into contact with the upper ramp 62. As the drawer nears the fully extended position, this upper face 62 pushes downwards on the rear end of the drawer. At the end of the ramps there is a stop 64 in the form of a vertical wall. When the drawer is fully extended, the rollers butt against the wall 64 and do not roll any further. Below the stop 64 is a slot 68 or opening in the lower flange. When the rear of the drawer is pulled down from the stop 64 into the slot 68, it can be removed from the drawer runner through the slot. This is described in more detail with respect to FIGS. 11-14.

Figure 6:
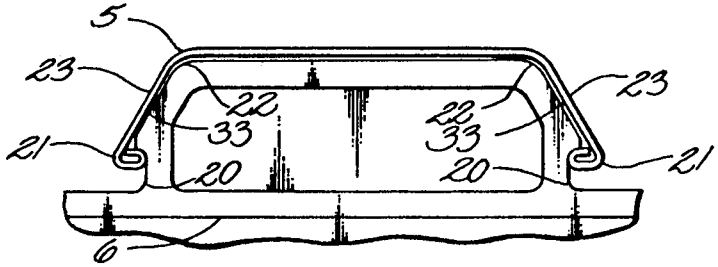
FIG. 6 is a fragmentary side view of a drawer runner boss and the end of a shelf plank.

FIG. 6 shows how the drawer runner bosses are held by the shelf planks. Each boss has a flattened trapezoidal shape with rounded upper corners 22 and a channel 20 at each side of its base for receiving inwardly directed lips 21 of a shelf plank. In other words, the bosses protrude into the shelf planks a small amount above each channel to provide a place for connecting the brackets onto the planks. Each shelf plank has a flattened trapezoidal U-shaped cross section with an inwardly directed lip 21 at the end of each leg 23 of the U. The descending and diverging legs form the front and rear faces of the plank. Each lip has a double thickness with a lower inwardly directed portion and an upper outwardly directed portion above it. This provides a smooth folded edge along the inward edge of the lip. The rough or sharp cut edge of the steel strip that forms the shelf plank is safely folded inside. The distance between the edges of the lips along each edge of the plank is more than the width of the top face of the plank so that a plurality of planks can be nested for packaging and shipment. The shelf plank may be constructed of many different materials, preferably light weight roll-formed pre-painted steel which has resilient properties allowing for transverse elastic deformation. The shelf planks may be of different lengths as desired for making a particular assembly of shelves to fit a closet.

Each runner is attached to the shelf planks by placing the bosses below the shelf planks so that they are straddled by the plank with one plank leg 23 over each side of a boss and then applying a steady upward pressure. Initially each inwardly directed lip 21 of the shelf plank abuts a diagonally canted face 33 of the trapezoidal boss. As pressure is applied to the bottom of the drawer runner, the plank legs are cammed outwardly by the interaction between the shelf plank lips and the diagonal faces of the boss. When each lip travels past the lower edge of the boss, the elasticity of the plank leg causes the leg to be snapped into the boss channel 20, thereby removably locking the shelf plank to the boss. The tight engagement of the planks with the runner stiffens and rigidifies the shelving system. The planks remain bent a small amount when engaged with the bosses to fit tightly. The drawer runners enhance the stiffening and rigidifying effect of the brackets.

When it is desired to hang a drawer from a location distant from a bracket and hanger bar, the drawer runner has an even more significant effect in solidifying the planks because there would not normally be any other stiffening member in such a location. The preferred arrangement using bosses and shelf planks is not necessary to practice the present invention. Many different mounting arrangements can be used with the disclosed shelf planks. If parallel planks are not used as the upper supporting member for the drawer runners, the mounting arrangement can be varied to suit as well.

Figure 7:
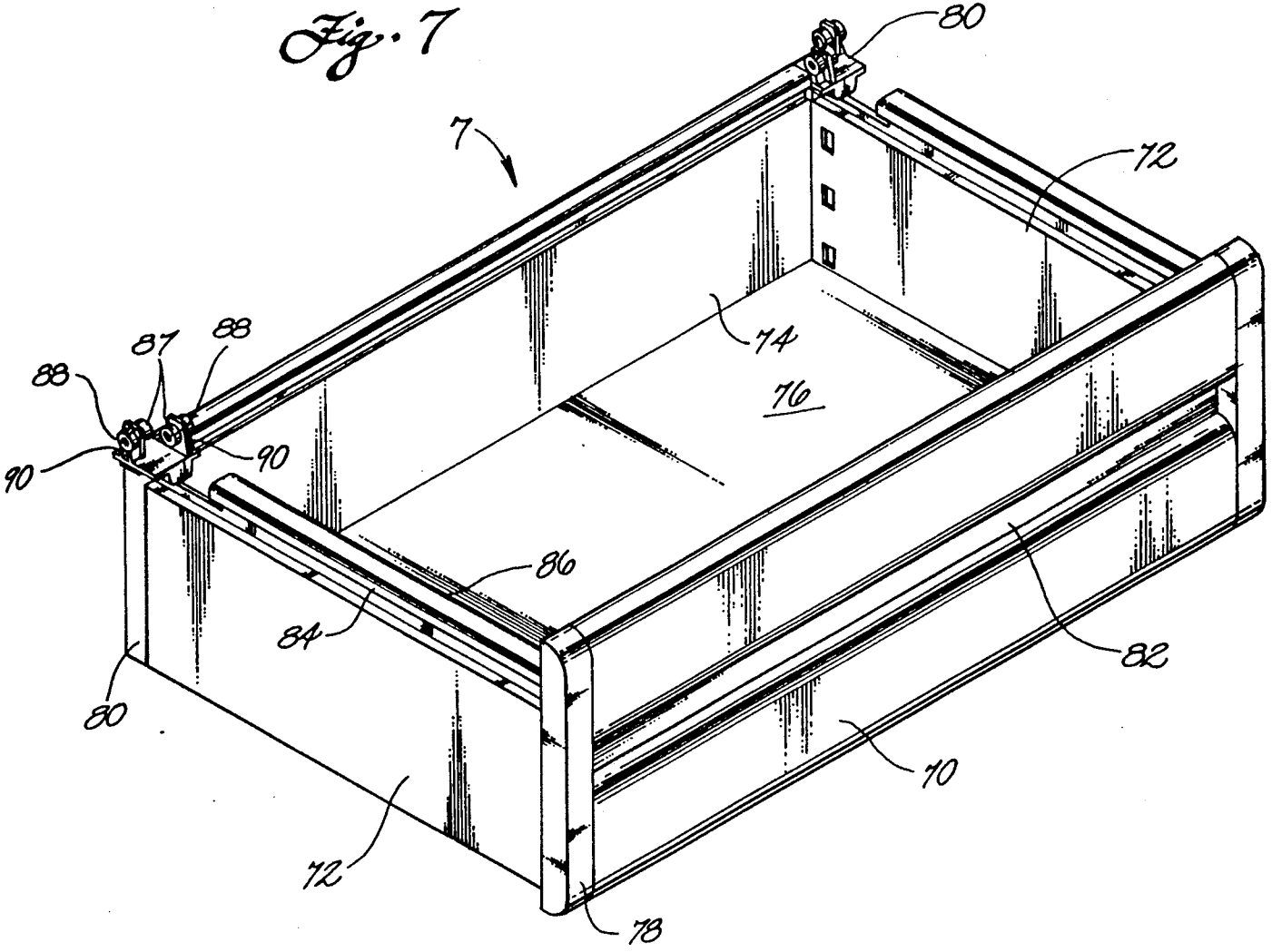
FIG. 7 is an isometric view of a drawer.
Figure 8:
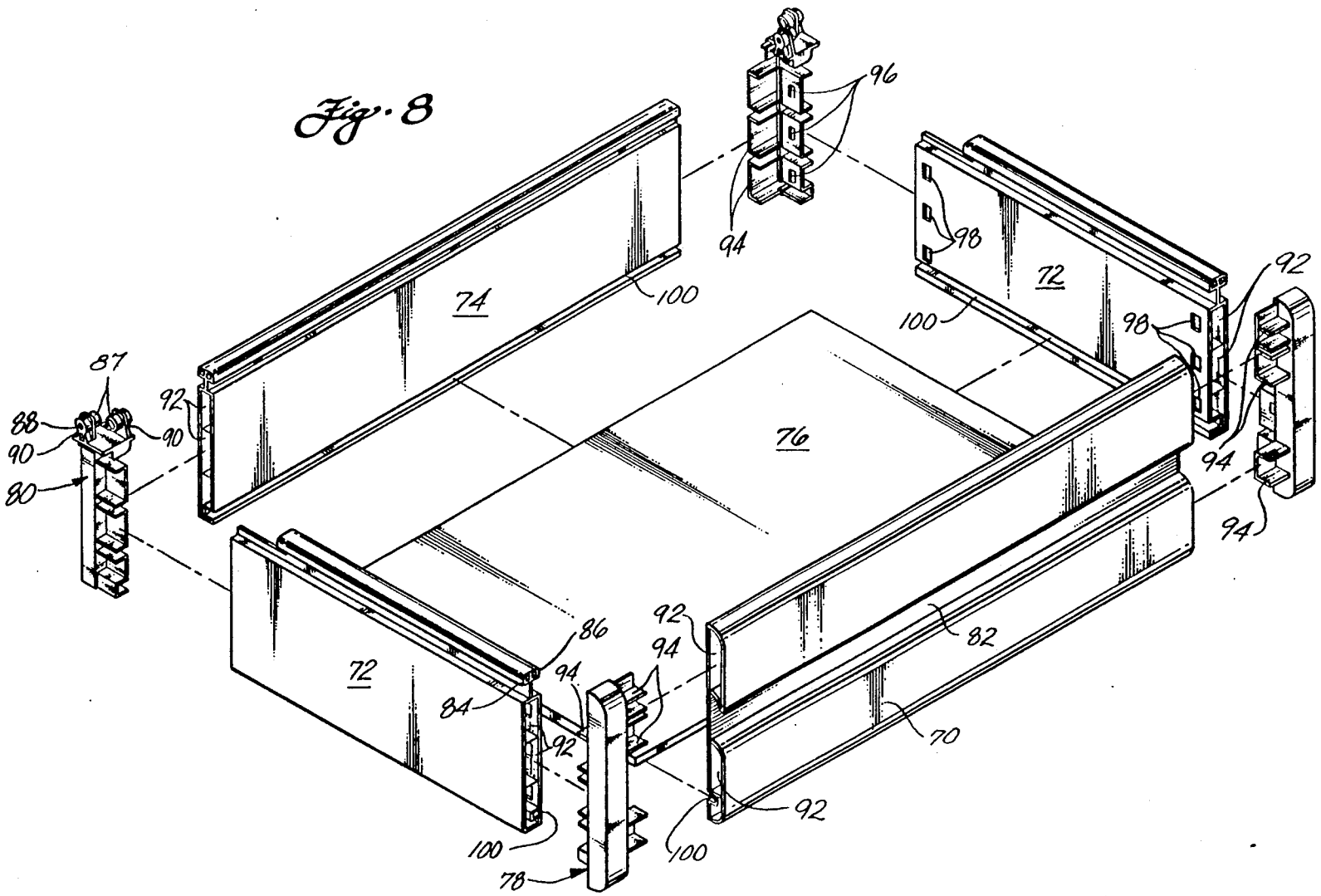
FIG. 8 is an exploded isometric view of the drawer of FIG. 7.

FIGS. 7 and 8 show a drawer adapted to work with the runners of FIGS. 3–5. The drawer is constructed from a drawer front 70, symmetric drawer sides 72, a drawer back 74, and a drawer bottom 76. The front is held to the sides with symmetric front corner connectors 78, and the back is held to the sides with symmetric rear corner connector and hanger assemblies 80. The drawer front has an indentation forming a drawer handle 82. At the top of each drawer side, there is a T-shaped flange comprising two flanges which extend perpendicular to the drawer sides in substantially opposite directions from each other, an outward directed flange 84 and an inward directed flange 86 forming the arms of the T. These drawer flanges extend along the length of the respective drawer side except for the very rearward portion which is left open. The flanges form slides which engage the wheels 50 on the runners when the drawer is installed as shown in FIGS. 11–14. The opening or slot at the rearward end of the drawer slides allows the drawer to be installed on and removed from the runner as shown in FIGS. 13 and 14.

The rear corner connector 80 includes a hanger assembly which has its own wheels 87 connected by axles 88 to legs 90. The legs extend upwardly from the rear corner connector to hold the wheels above the outwardly extending flanges 84 and 86. The wheels are designed to roll against the flanges on the drawer runner as shown in FIGS. 11–14. The legs, axles and wheels form a hook for suspending the drawer from the runner. While rollers are preferred to ensure smooth operation, a simpler hook without any rolling capability can be used instead. Similarly, the drawer runner's legs, axles and wheels can also be replaced with a simpler variety of hook.

As can be seen in FIG. 8, the front side and back portions of the drawer are all primarily hollow. This reduces weight and the amount of material required for each drawer. They are preferably formed from an extruded plastic, for example, polyvinyl chloride with interior cavities 92. The interior cavities provide an opening for tabs 94 in the corner connectors to be inserted. This is a great convenience for shipping because the drawers can be shipped unassembled in a small package with the parts stacked. The drawers can then quickly be unpacked and assembled by inserting the tabs 94 of each of the corner connectors into the corresponding cavities 92 in the side, front and back walls. Each tab includes a resilient wing 96 which snaps into a hole 98 in the sides or back of the drawer walls when the parts are assembled. The corner connectors 78, 80 are preferably made from a resilient and strong material, for example, reinforced polypropylene.

To assemble the drawer, the rear corner connector and hanger assemblies are snapped into place on the drawer back. The drawer side walls are then connected to the rear corner connectors. The drawer bottom is slid into a groove 100 molded into each of the drawer walls. The front corner connectors are next snapped into place on the drawer front, and the drawer front with connectors is coupled to the drawer sides.

Figure 9:
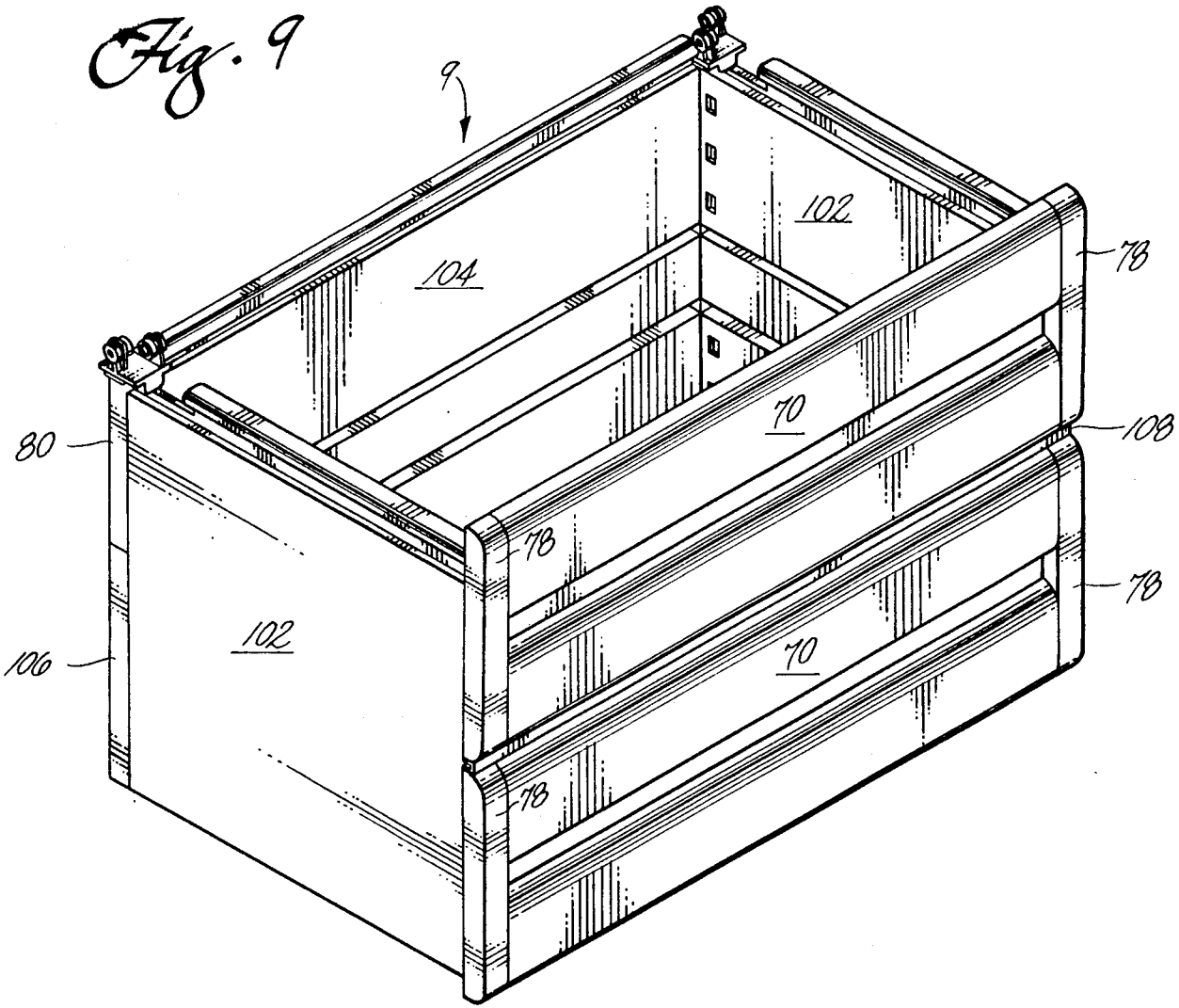
FIG. 9 is an isometric view of a drawer with double the depth of the drawer of FIG. 7.
Figure 10:
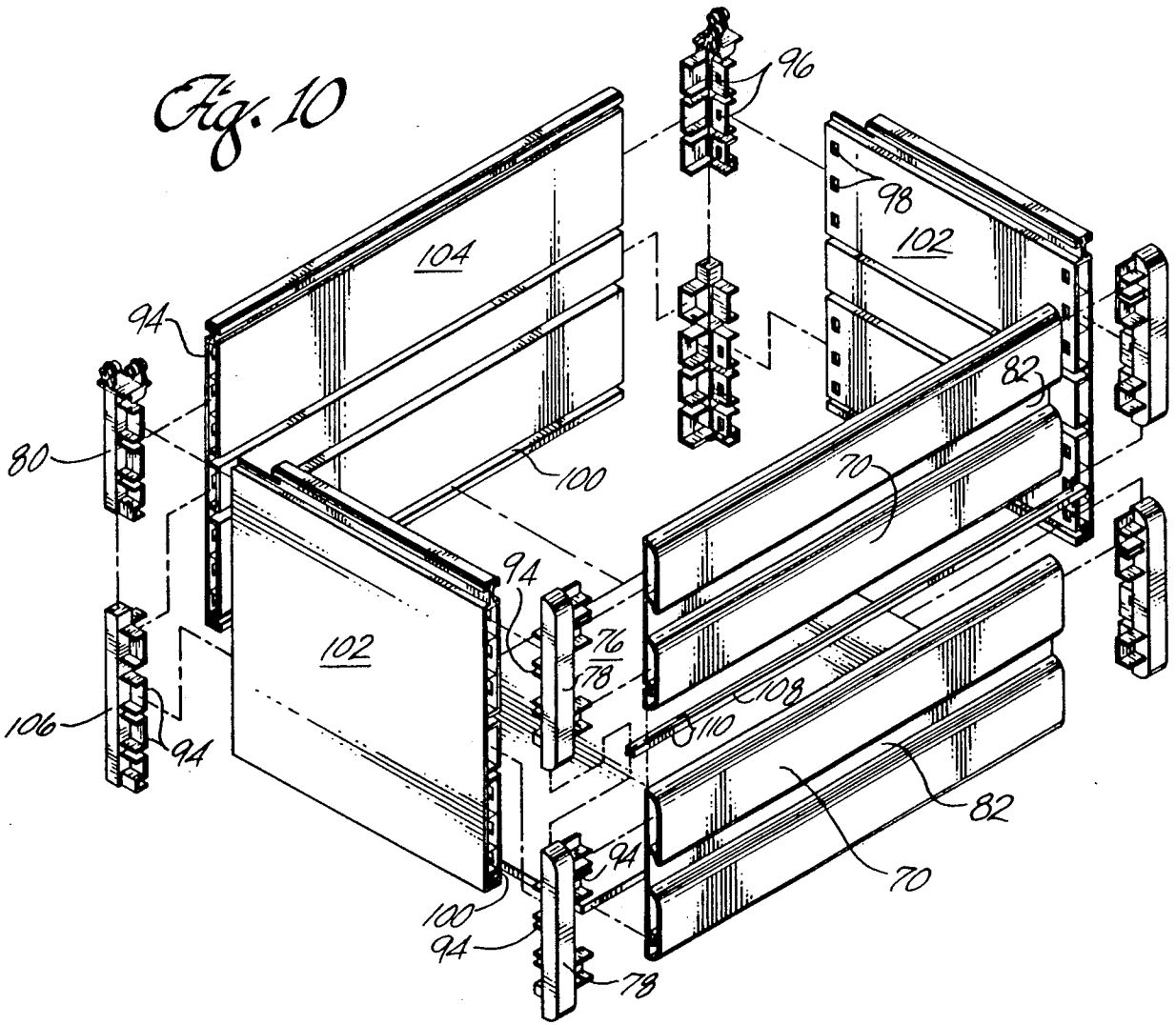
FIG. 10 is an exploded isometric view of the drawer of FIG. 9.

FIGS. 9 and 10 show a double depth drawer made using many of the same components used for the single depth drawer. The drawer sides 102 and drawer back 104 are twice the depth of the drawer side walls and back wall for the single depth drawer. However, they nevertheless include an identical groove 100 (FIG. 10) into which an identical bottom 76 is inserted. A second rear corner connector 106 without a hanger assembly is used to accommodate the additional depth and the additional tabs 94 required by the double depth drawer. As with the single depth drawer, these tabs are inserted into cavities 92 in the side and back walls and resilient wings 96 snap into place in the holes 98 in the side and back walls. Alternatively, a single rear corner connector with double the length of those illustrated can be used.

The double depth drawer uses two drawer fronts 70 identical to that shown in FIGS. 7 and 8. These are connected to the side walls with front corner connectors 78 also identical to those shown in FIGS. 7 and 8. One side corner connector is used to connect each side of each front panel to each side wall, making a total of four. When the front walls are connected in this way there is a small gap between the upper and lower front panels. This gap is filled with a front gap cover 108. The gap cover is made of a resilient material which matches or complements the material from which the front panels are made, for example, polyvinyl chloride. The cover has curved upper and lower surfaces 110 which are pushed together and squeezed between the two front panels. When the gap cover is in place it is secured in a recessed position between the front panels and held in place by the curved surfaces. The drawer is assembled in the same way as the single depth drawer, except that the additional corner connectors are used and the gap cover is snapped into place after the other parts have been assembled.

Figure 11:
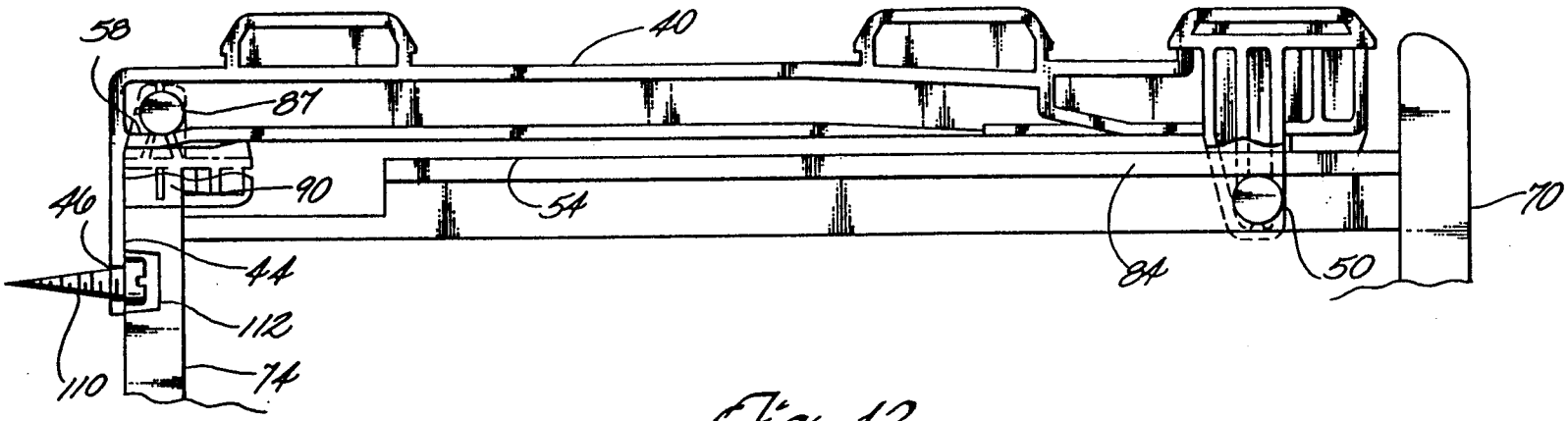
FIG. 11 is a fragmentary side view of a drawer runner in engagement with a drawer in the closed position, partially cut away to show the positions of the rollers and flanges.

FIGS. 11-14 show how the wheels cooperate with the flanges when a drawer is inserted onto runners 40. FIG. 11 shows a portion of a drawer and a runner when the drawer is in a closed position. When closed, the back 74 of the drawer rests against the runner's vertical rear end plate 44. In a closet application, the vertical plate provides a durable surface against which the drawer can be closed which is held firmly in place by a screw 110 extending into the closet wall. The drawer back has a hole 112 aligned with the plate's screw hole 46 to prevent the screw from hitting the drawer back.

The wheels 87 of the drawer's rear corner connector 80 rest in the depression 58 in the drawer runner's lower flange. The weight of the rear of the drawer and its contents tend to hold the wheels in the depression and hold the drawer in the closed position. The wheels do not sit at the lowest point in the depression, but on a slight incline. As a result, the drawer is urged by gravity against the vertical plate 44. The front of the drawer is supported by the drawer runner's wheels 50. The drawer's flanges 84 and 86 rest on the drawer runner's wheels 50. The drawer is substantially level.

Figure 12:
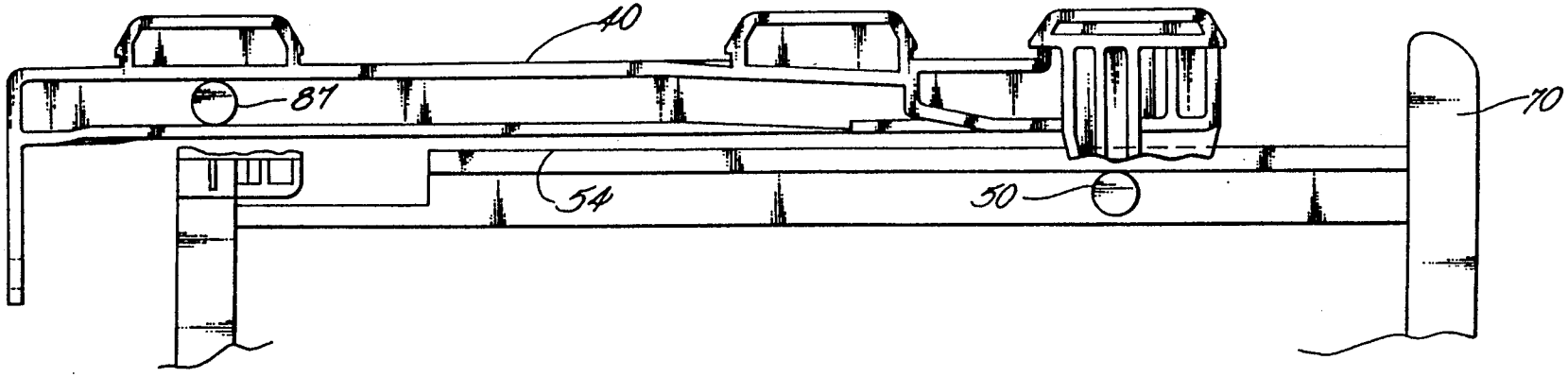
FIG. 12 is a side view similar to that of FIG. 11 showing the drawer partially open.
Figure 13:
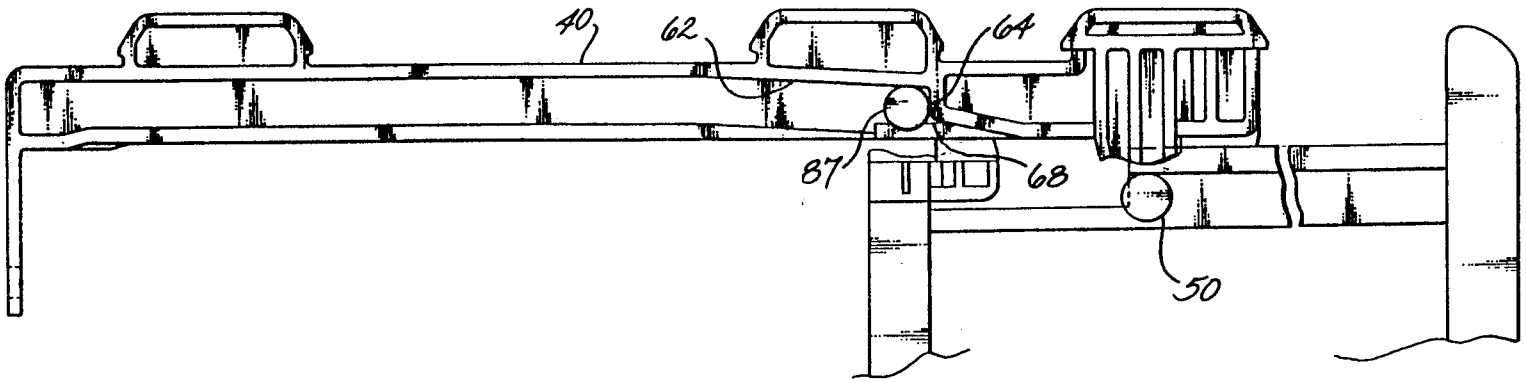
FIG. 13 is a side view similar to that of FIG. 11 showing the drawer fully open.
Figure 14:
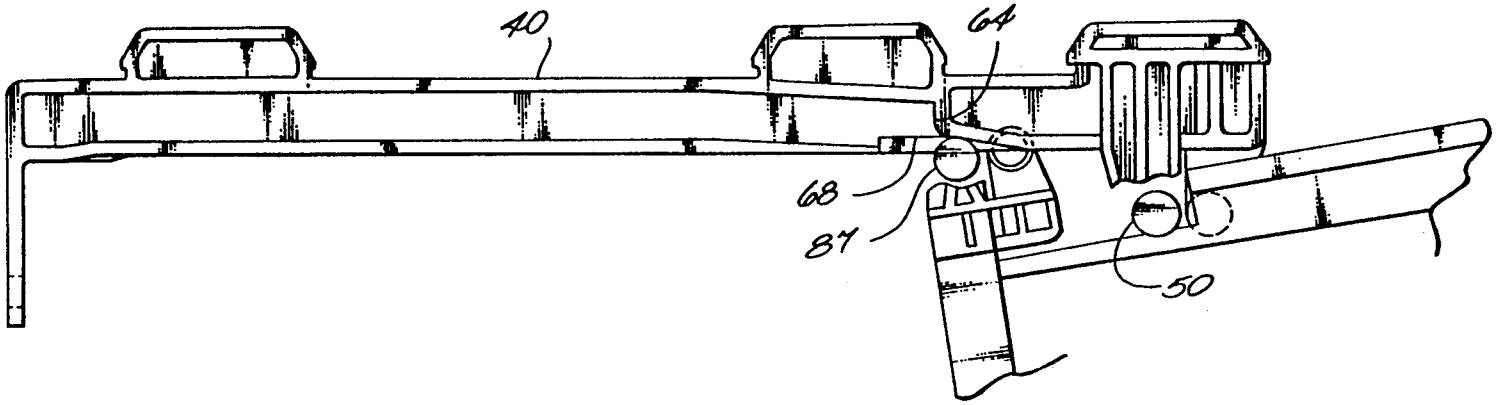
FIG. 14 is a side view similar to that of FIG. 11 showing the drawer partially removed from the drawer runner.

To open the drawer, the front drawer panel 70 is pulled forwards or to the right as shown in FIGS. 12 through 13, pulling the drawer mounted wheels 87 up out of the depression and onto the substantially flat upper surface of the majority of the drawer runner's T-shaped flanges as shown in FIG. 12. This puts the drawer at a slight incline.

The drawer mounted wheels 87 continue to support the rear of the drawer as they roll along the flanges, and the drawer runner's wheels 50 support the portion of the drawer which rolls below it. The location of the drawer runner's wheels moves progressively further back along the drawer as the drawer is pulled out. Eventually, the weight of the drawer in front of the drawer runner wheels is greater than that behind the drawer runner wheels. The drawer mounted wheels are then pushed upward and roll against the downwardly facing surface of the drawer runner's upper flanges. Since the distance between the upwardly and downwardly facing flange surfaces (for example, about 117 mm) is only a little greater than the diameter of a wheel (about 113 mm), the movement of the wheels between the two surfaces does not noticeably upset the drawer. As the drawer continues to move outward, the wheels encounter a ramp 62 on the downwardly facing upper face which pushes the wheels downward. Since the drawer runner wheels 50 are still in contact with the flange above the drawer side wall, the ramp pushes the rear end of the drawer downward and accordingly pushes the front end of the drawer upward. Since most of the drawer is forward of the drawer runner wheel, the energy required to do this slows the drawer before the wheel 87 hits the stop 64 at the end of the ramp as shown in FIG. 13. The drawer is now tilted so that the front of the drawer is angled slightly upward.

The slots and wheels on the drawer are spaced further apart than the slots and wheels on the runners. Accordingly, when the drawer is fully opened, the runner's wheels still support the front of the drawer. To remove the drawer, the drawer front is lifted still further upward so that the drawer mounted wheels are pulled through the slots 68 in the drawer runner, allowing the drawer to move still further forward and the runner mounted wheels to be drawn past the end of the side wall flanges as shown in FIG. 14. The wheels are then moved away from their respective flanges and the drawer can be removed.

As best seen in FIG. 3, the forward end of the ramp on the upwardly facing surface of each drawer runner bottom flange has a radiused or curved edge 114. The curve on this edge prevents the legs which support the drawer mounted wheels from getting caught on the ramp when the drawer is inserted and removed. However, there is still sufficient surface area to keep the wheels from becoming accidentally removed. In addition, the central wall of the runner in the area of the slot 68 has a double chamfer 116 between the ramp and the end of the slot. As a result, the central wall has a thin, sharp edge at the slot and then flares out to the central wall's regular width. The chamfer helps guide the drawer mounted wheels to their respective sides of the drawer runners when the drawer is inserted.

In using the drawer and drawer support system of the present invention with a modular shelving and hanging bar system, the user must initially decide on an overall shelf, hanger bar, and drawer configuration. Many configurations are possible and can vary in complexity and size from a simple shelf and drawer to a more elaborate combination of bracket shelf planks, vertical supports and drawers such as that shown in FIG. 1. Once an overall configuration is chosen, the shelves and vertical supports are first installed and then the drawer runners are installed at the chosen locations. The drawer is then inserted to make certain that the drawer runners are properly positioned and the drawer runners are then secured to the rear wall through the screw holes.

A variety of other patterns of alternating notches and bosses may be provided along the tops of the drawer runners for elastically engaging shelf planks. For example, planks might be provided with an inverted trapezoidal cross section to fit into notches between bosses. These can be used in lieu of the planks described and illustrated above or could, with only minor modifications, be interspersed between the illustrated planks to make a shelf that is essentially continuous. The present invention can also be applied to a flat, solid shelf or other member capable of supporting runners and a drawer. For a household closet organizer, it is presently preferred that the drawers each be approximately 50 centimeters wide, 30 centimeters long and 15 centimeters deep, the double depth drawer being approximately 30 centimeters deep. The drawer runners are each preferably approximately 3 centimeters wide, each flange being approximately ½ centimeter wide to accommodate wheels of similar width. The drawer runner wheels have their axis about 1½ centimeters below the flange. The shelf planks are about 5 centimeters wide. The planks are each about 4 centimeters apart.

Many modifications and variations of the drawers and runners are feasible within the scope of this invention. The drawers may take on any desired appearance and the drawer handles can assume a variety of shapes.

It is not intended to limit the scope of protection by describing only the embodiment shown above.

What is claimed is:

1. A drawer support system for suspending a drawer from below a plurality of planks comprising:

at least two elongated drawer runners each having a length extending transverse to the planks and supported below the planks for supporting opposite sides of the drawer from above, each runner having (a) a plurality of bosses spaced apart along the length of each runner for engaging the plurality of planks from below the planks without use of fasteners between the planks and runner, each boss having a trapezoidal U-shaped cross section in a plane extending along the length of the runner for elastically engaging a plank; and (b) means for slidably engaging the drawer along the top of each side of the drawer.

2. The system of claim 1 wherein the means for engaging the drawer comprises at least one flange extending from each runner.

3. The system of claim 2 wherein the flange has an upwardly facing surface for engaging and supporting the drawer and wherein the upwardly facing surface has a depression adjacent to the back of the runner for engaging the drawer when the drawer is in a closed position and retaining the drawer in the closed position.

4. A drawer support system for suspending a drawer from below a plurality of planks comprising:

at least two elongated drawer runners for supporting opposite sides of the drawer from above, each runner having (a) means for engaging the plurality of planks from below the planks; and (b) at least one flange extending from the runner to slidably engage a side of the drawer, wherein the runner has a ramp facing the flange for slowing the drawer as it is moved toward a fully opened position.

5. The system of claim 4 wherein the runner has a substantially vertical wall near the front of each flange adapted to abut the drawer when the drawer is in a fully open position for restricting the drawer from opening further.

6. A drawer support system for suspending a drawer from below a plurality of planks comprising:

at least two elongated drawer runners for supporting opposite sides of the drawer from above, each runner having (a) means for engaging the plurality of planks from below the planks; and (b) at least one flange extending from the runner to slidably engage a side of the drawer, wherein the means for engaging the drawer comprises a T-shaped flange attached to the top of each side of the drawer, the T-shaped flange comprising two flanges extending in substantially opposite directions from each drawer side.

7. The system of claim 1 wherein the means for engaging the drawer comprises a roller adjacent to the front of the runner for rolling against a surface of the drawer.

8. The system of claim 6 wherein the means for engaging each side of the drawer to the corresponding runner comprises at least two rollers associated with the runner, each roller being adapted to engage a different oppositely extending flange on top of a side of the drawer.

9. The system of claim 1 wherein the plans are supported adjacent a wall and the support system comprises means for fastening each drawer runner to the wall.

10. A drawer and drawer support system for suspending a drawer from each side directly below an upper supporting member comprising:

a drawer having a forward end, two sides and a rearward end;

a hook fastened to the drawer's rearward end near where each side meets the rearward end for supporting the drawer from above;

a drawer runner, attachable to an upper supporting member, located above each side of the drawer, each runner having a flange with an upwardly facing surface for engaging the respective hook and supporting the drawer between a forward open and a rearward closed position, the surface having a forward end and a rearward end; and a ramp near the forward end of the surface for pushing the hook downward as the drawer is moved to the open position.

11. The system of claim 10 wherein the ramp comprises a downwardly facing surface.

12. The system of claim 11 wherein the runner comprises a substantially vertical wall near the ramp for abutting the hook when the drawer is in the open position restricting the drawer from further forward movement.

13. The system of claim 12 wherein the ramp has a forward end proximate the forward end of the surface and the substantially vertical wall is proximate the forward end of the ramp.

14. The system of claim 10 wherein the runner comprises a slot at the forward end of the surface for allowing the hook to be disengaged from the surface.

15. The system of claim 10 comprising a depression at the rearward end of the surface for engaging the hook when the drawer is in the closed position and retaining the drawer in the closed position.

16. The system of claim 10 wherein the hook comprises a roller.

17. The system of claim 10 wherein the drawer runner surface comprises two flanges extending in substantially opposite directions away from the runner and the hook comprises two rollers, one roller being adapted to roll on each flange.

18. A drawer and drawer support system for suspending a drawer from each side directly below an upper supporting member comprising:

a drawer having a forward end, two sides and a rearward end;

a hook fastened to the drawer's rearward end near where each side meets the rearward end for supporting the drawer from above;

a drawer runner, attachable to an upper supporting member, located above each side of the drawer, each runner having a flange with an upwardly facing surface for engaging the respective hook and supporting the drawer between a forward open and a rearward closed position, the surface having a forward end and a rearward end; and a ramp near the forward end of the surface for pushing the hook downward as the drawer is moved to the open position; wherein the drawer runner surface comprises two flanges extending in substantially opposite directions away from the runner and the hook comprises two rollers, one roller being adapted to roller on each flange and the axis of rotation of one roller is forward of the axis of rotation of the other roller.

19. A drawer and drawer support system for suspending a drawer from each side directly below an upper supporting member comprising:

a drawer having a forward end, two sides and a rearward end;

a hook fastened to the drawer's rearward end near where each side meets the rearward end for supporting the drawer from above;

a drawer runner, attachable to an upper supporting member, located above each side of the drawer, each runner having a flange with an upwardly facing surface for engaging the respective hook and supporting the drawer between a forward open and a rearward closed position, the surface having a forward end and a rearward end;

a ramp near the forward end of the surface for pushing the hook downward as the drawer is moved to the open position;

a hook on the runner forward of the upwardly facing surface for supporting the drawer; and a downwardly facing surface on the drawer for slidably engaging the hook and supporting the drawer between a forward open and a rearward closed position.

20. The system of claim 19 wherein the hook comprises a roller.

21. An overhead drawer support system comprising:

a drawer having a front, a back, two sides and a bottom;

a T-shaped flange extending along the top of each side of the drawer;

a runner supported above each side of the drawer, each runner having a T-shaped flange along the bottom;

a pair of wheels attached to each runner near its front end, straddling the leg of the T-shaped flange on one side of the drawer; and a pair of wheels attached to each drawer side near its back end, straddling the leg of the T-shaped flange on the adjacent runner, the wheels collectively engaging the top of each respective T-shaped flange for supporting the weight of the drawer and permitting movement of the drawer in the front to back direction.

22. A drawer support system as recited in claim 21 wherein each pair of wheels comprises a first wheel nearer the front of the drawer and a second wheel nearer the back of the drawer.

23. A drawer support system as recited in claim 22 further comprising a slot through each T-shaped flange along the side of the drawer near the back of the drawer for receiving the wheels on the respective runner and a slot through each T-shaped flange on a runner near the front of the runner for receiving the wheels on the respective side of the shelf for installing or removing the drawer from the support.

24. A drawer support system as recited in claim 23 wherein the slot through the T-shaped flange on the runner comprises a first slot through one arm of the T for receiving one wheel and a second slot through the other arm of the T offset from the first slot for receiving the other wheel.

25. A drawer support system as recited in claim 21 further comprising a slot through each T-shaped flange along the side of the drawer near the back of the drawer for receiving the wheels on the respective runner and a slot through each T-shaped flange on a runner near the front of the runner for receiving the wheels on the respective side of the shelf for installing or removing the drawer from the support.

26. A drawer support system as recited in claim 25 wherein the slots and wheels are spaced apart a greater distance on the drawer than on the runners so that a portion of the weight of the drawer is supported on the runner wheels when the wheels on the drawer are aligned with the slots in the runners.

27. A drawer support system as recited in claim 21 wherein each T-shaped flange on a runner comprises a depression in both arms of the T near the back of the runner for receiving the wheels on the drawer and providing a detent for retaining the drawer in its closed position.

28. A drawer support system as recited in claim 25 wherein each runner comprises a sloping ramp portion adjacent to the slot in the runner for causing the wheels on the drawer to move gradually downwardly and retard movement of the drawer as it approaches its fully open position.

29. An overhead drawer support system comprising:

a drawer having a front, a back, two sides and a bottom;

an inner channel extending along the top inner side of each side of the drawer;

an outer channel extending along the top outer side of each side of the drawer;

a runner supported above each side of the drawer, each runner having an inner channel and an outer channel along the bottom;

a pair of wheels attached to each runner near its front end and fitted into the respective inner and outer channels on one side of the drawer; and a pair of wheels attached to each drawer side near its back end and fitted into the respective inner and outer channels in the adjacent runner, the wheels collectively engaging the surfaces of each respective channel for supporting the weight of the drawer and permitting movement of the drawer in the front to back direction.

* * * * *